United States Patent [19]

Provost

[11] Patent Number: 4,955,981

[45] **Date of Patent: * Sep. 11, 1990**

[54] RECLOSABLE BAG HAVING HOOK AND LOOP SEALING STRIPS

[75] Inventor: George A. Provost, Litchfield, N.H.

[73] Assignee: Velcro Industries B.V., Amsterdam, Netherlands

[ * ] Notice: The portion of the term of this patent subsequent to Apr. 25, 2006 has been disclaimed.

[21] Appl. No.: 178,841

[22] Filed: Apr. 1, 1988

Related U.S. Application Data

[63] Continuation of Ser. No. 38,424, Apr. 10, 1987, abandoned, which is a continuation of Ser. No. 790,966, Oct. 24, 1985, abandoned.

[51] Int. Cl.[5] ..... B65D 33/24; A44B 18/00

[52] U.S. Cl. ..... 383/86; 24/306; 24/444; 206/610; 206/618; 383/99

[58] Field of Search ..... 206/610, 616–618; 383/5, 84, 86, 98, 99; 24/306, 442–450

[56] References Cited

U.S. PATENT DOCUMENTS

| | | | |
|---|---|---|---|
| 3,279,008 | 10/1966 | Wallach | 24/306 X |
| 3,307,872 | 3/1967 | Murcott | 24/306 X |
| 3,321,126 | 5/1967 | Rivman et al. | 206/616 |
| 3,557,853 | 1/1971 | Jones | 383/86 |
| 3,651,519 | 3/1972 | Glick | 24/450 X |
| 3,807,626 | 4/1974 | Goodrich | 206/618 X |
| 4,067,609 | 1/1978 | Ness | 24/442 X |
| 4,094,021 | 6/1978 | Rapp | 24/306 X |
| 4,567,987 | 2/1986 | Lepisto et al. | 206/616 |
| 4,580,683 | 4/1986 | Goehenour | 206/610 |
| 4,617,214 | 10/1986 | Billarant | 24/444 X |

*Primary Examiner*—Bryon P. Gehman

*Attorney, Agent, or Firm*—Hayes, Soloway, Hennessey & Hage

[57] ABSTRACT

A tamperproof, resealable bag of the type used to sell and store materials such as dog food, and the like. A unique sealing strip of the hook and loop fastening variety is employed therein. The bag is a flexible, frangible material such as paper and includes a flap extending from the rear edge over the front edge and down along the front piece. A strip of adhesive is disposed along the bottom edge of the flap to secure it to the front piece. A piece of cording is disposed between the flap and the front piece adjacent the top of the adhesive strip with an end extending outward therefrom for gripping. The two strips comprising the hook and loop fastening system are disposed between the flap and the front piece above and adjacent to the cording with one of the strips adhesively attached to the flap and the other to the front piece of the bag. When the cording is pulled across the flap, the flap is fractured and separated along the line close adjacent the lower edge of the strip so that thereafter the outer one of the strips can be gripped to pull the pair of strips out of attachment to one another without pulling the flap apart from its adhesive attachment to its strip. In the preferred embodiment, the strips include an area adjacent the bottom edge where the hooks are not included such that the strips can be rolled apart for gripping.

7 Claims, 5 Drawing Sheets

RECLOSABLE BAG HAVING HOOK AND LOOP SEALING STRIPS

This is a continuation of co-pending application Ser. No. 038,424 filed on Apr. 10, 1987, which is a continuation of Ser. No. 790,966, filed on Oct. 24, 1985.

BACKGROUND OF THE INVENTION

The present invention relates to resealable bags, and, more particularly, to a bag of a flexible, frangible material, including a bottom, opposed spaced sides, and opposed spaced front and rear pieces terminating at the top and front and rear edges respectively, wherein tamperproof resealability is provided by a flap of the flexible, frangible material extending from the rear edge over the front edge and down along the front piece; a strip of adhesive disposed along the bottom edge of the flap to secure it to the front piece; a piece of cording disposed between the flap and the front piece adjacent the top of the adhesive strip with at least one end extending from between the flap and the front piece sufficiently for gripping; and, a pair of strips of a hook and loop fastening system disposed between the flap and the front piece above and adjacent to the cording with one of the pair of strips adhesively attached to the flap and the other of the pair of strips adhesively attached to the front piece whereby when the cording is pulled across the flap, the flap between the pair of strips and the strip of adhesive is fractured and separated along a line close adjacent the lower edge of the strip so that thereafter the one of the pair of strips can be gripped to pull the one of the pair of strips out of attachment to the other of the pair of strips without pulling the flap apart from its adhesive attachment to the one of the pair of strips.

Resealable bags have been known in the art for years. For example, before it became popular to sell previously ground coffee in vacuum packed cans, coffee was sold as whole roasted beans in a bag such as that generally indicated as 10 in FIG. 1. The coffee bag 10 had metal tabs 12 extending outward from one side of the top. The two sides of the top were pinched together by folding the sides as at 14. The top of the bag was then rolled down so as to appear as in FIG. 2 when viewed in the direction of arrow II in FIG. 1. The metal tabs 12 were then bent around the folded-down top 16 as shown in FIGS. 2 and 3. When the coffee was purchased, the metal tabs 12 were unfolded, the folded top 16 unrolled, and the beans (not shown) poured out of the bag 10 into a grinder from whence they were directed from a shoot back into the bag 10 which was then resealed in the manner described above.

More recently, the sale of "economy size" bags of pet food, and the like, has increased in popularity. Large bags of such materials open at the top are easily spilled and, therefore there has been a corresponding desirabilty of providing a tamperproof resealable form for such bags. That is, such bags are normally sealed shut until time of use. At that time, a tear strip is removed allowing the bag to be opened. Thus, the object is to provide resealability for such sealed or tamper-proof bags.

A recent attempt at a solution to the problem is shown in FIGS. 4–6. As shown therein the bag 18 is folded over at 20 to provide abutting edges, 22, 24 adjacent the top of the bag. A zipper, generally indicated as 26, of the type having two sides 28, 30 carrying intermeshing plastic loop teeth 32 is attached to the abutting edges 22, 24 and covered with a sealing strip 34. At time of initial use, the sealing strip 34 is peeled off of the zipper 26 as indicated by the arrow 36. The zipper 26 can then be opened by pulling the tab 38 and the direction of arrow 40 in the usual manner of operation for zippers. To close the bag, the tab 38 is pulled in the direction opposite arrow 40, also in the conventional manner. With the zipper 26 in its open position, the abutting edges 22,24 can be pulled apart to provide an entrance into the bag 18 as symbolized by the arrow 42 in FIG. 6.

The use of a zipper in such applications has numerous drawbacks. The zipper 26, as is typical, is an entity comprising its two sides 28,30 and the tab 38 which must be mounted on the teeth 32 with the teeth 32 in proper meshed relationship. This, of course, adds greatly to the complexity and cost of construction of the bag 18. Moreover, as it also well known by anyone who has used zippers, any foreign material becoming lodged in the teeth 32 will prevent proper operation of the zipper 26. The tab 38 may become completely immovable. Additionally, if the zipper 26 is assumed closed, one may find that a piece of the material contained in the bag 18 has become lodged in the teeth 32 preventing proper intermeshing. Shortly thereafter, the teeth 32 will come out of engagement and the zipper 26 completely open allowing the contents of the bag 18 to spill.

Wherefore, it is the object of the present invention to provide a reclosable bag of the type described with respect to FIGS. 4–6 but eliminating the problems attendant thereto.

SUMMARY

The foregoing objective has been realized in a bag of a flexible, frangible material including a bottom, opposed spaced sides, and opposed spaced front and rear pieces terminating at the top in front and rear edges respectively, by the improvement of the present invention comprising:

- a flap of the flexible, frangible material extending from the rear edge over the front edge and down along the front piece;
- a strip of adhesive disposed along the bottom edge of the flap to secure it to the front piece;
- a piece of cording disposed between the flap and the front piece adjacent the top of the adhesive strip with at least one end extending from between the flap and the front piece sufficiently for gripping; and
- a pair of strips of a hook and loop fastening system disposed between the flap and the front piece above and adjacent the cording with one of the pair of strips adhesively attached to the flap and the other of the pair of strips adhesively attached to the front piece, the pair of strips including an area on their lower edge in which there is no ability for the pair of strips to form a releasable attachment to one another whereby when the cording is pulled across the flap, the flap between the pair of strips and the adhesive is fractured and separated along a line close adjacent the lower edge of the strips and thereafter the one of the pair of strips can be rolled back at the area away from the other of the pair of strips sufficiently to be gripped to pull the one of the pair of strips out of attachment to the other of the pair of strips without pulling the flap apart from its adhesive attachment to the one of the pair of strips.

The novel hook and loop fastening system employed in the bag of the present invention also has independent use where it is desired to employ a hook and loop strip fastening system adhesively fastened to respective sides of a closure and wherein delamination of the adhesive fastening during repeated opening and closing of the fastening system is desired to be avoided.

DESCRIPTION OF THE PREFERRED EMBODIMENT

Figure 1:
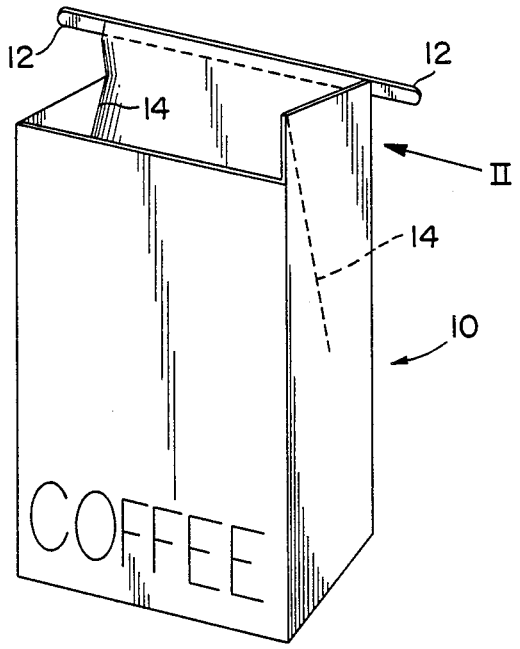
FIG.1 PRIOR ART
FIG. 1 is a perspective view of a reclosable bag such as used for coffee to permit opening and grinding at the point of sale.
Figure 2:
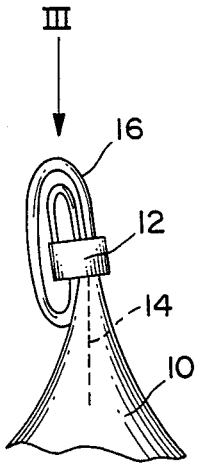
FIG.2 PRIOR ART
FIG. 2 is a view of the bag of FIG. 1 as it would appear in the direction of arrow II when the top is rolled down and the tabs folded over in the locked position.
Figure 3:
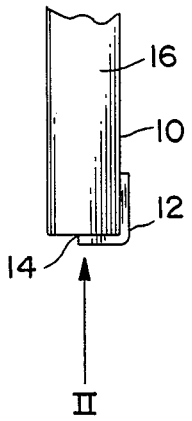
FIG.3 PRIOR ART
FIG. 3 is a top view of one end of FIG. 2.
Figure 4:
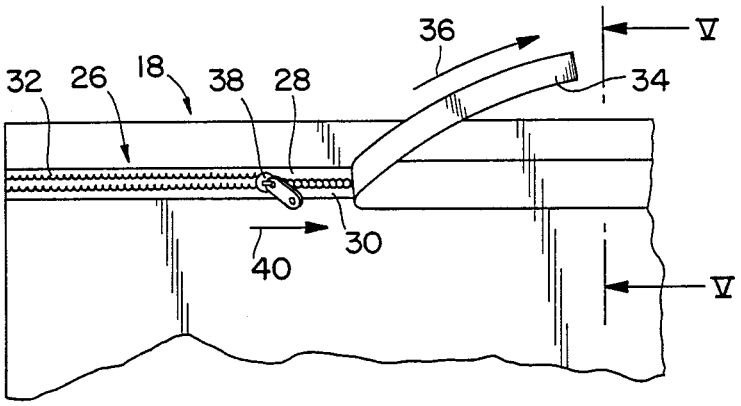
FIG. 4 PRIOR ART
FIG. 4 is a front view of a prior art approach to a resealable bag employing a zipper therein.
Figure 5:
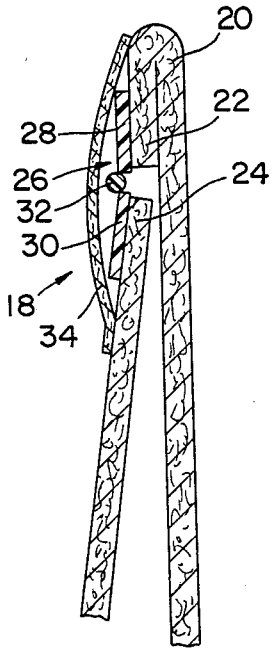
FIG. 5 PRIOR ART
FIG. 5 is a cutaway view of the bag of FIG. 4 in the Plane V—V.
Figure 6:
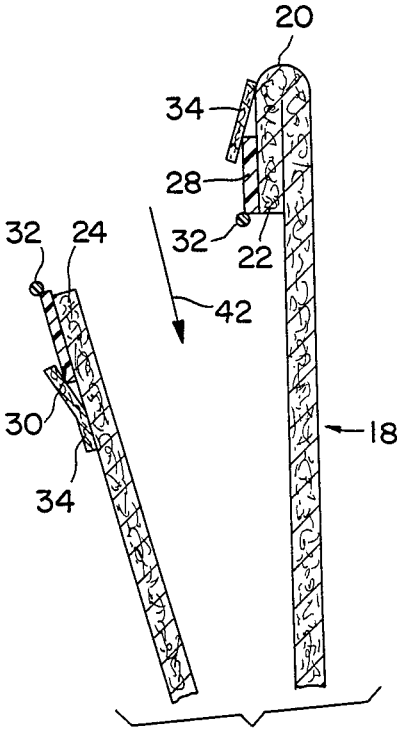
FIG. 6 PRIOR ART
FIG. 6 shows the bag of FIG. 4 in the Plane V—V as it would appear with the zipper opened and the bag opened for use.
Figure 7:
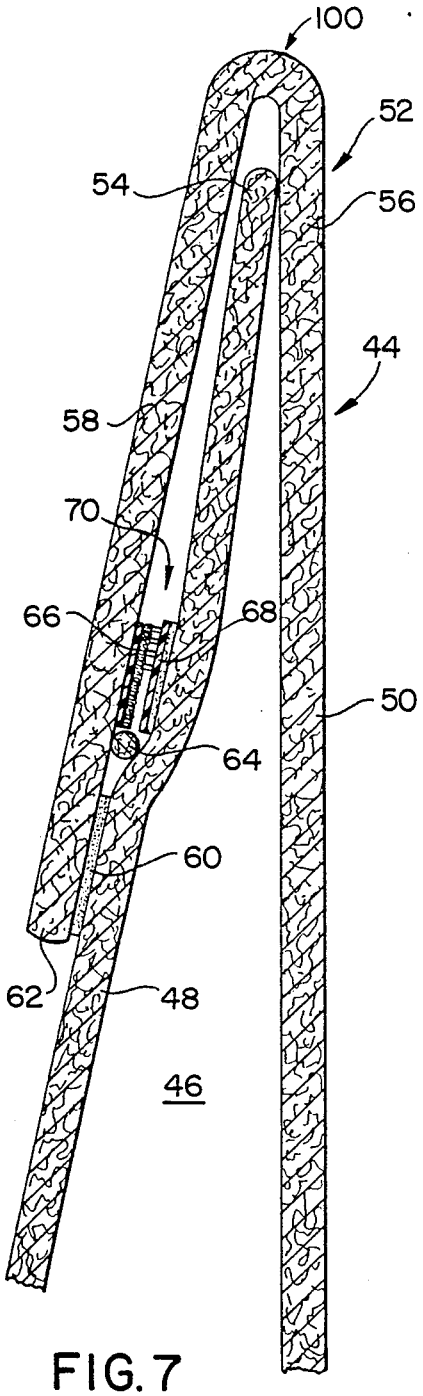
FIG. 7 is a cutaway side elevation through the top flap portion of a bag according to the present invention.

FIG. 7 shows the top of a bag 44 incorporating the present invention in its preferred embodiment. Bag 44, while possible to manufacture as a tubular construction with a sewn bottom, can generally be described as having a bottom (not shown), opposed spaced sides 46, and opposed spaced front and rear pieces 48,50, respectively, terminating at the top 52 in front and rear edges 54 and 56, respectively. Bag 44 is of a flexible, frangible material, typically multi-layer coated paper.

According to the present invention, a flap 58 of the same flexible, frangible material extends from the rear edge 56 over the front edge 54 and down along the front piece 48. A strip of adhesive 60 is disposed along the bottom edge 62 of the flap 58 to secure it to the front piece 48. Various forms of adhesive can be used at 60, however, adhesive of the hot melt variety is preferred for ease of manufacture. A piece of cording 64 is disposed between the flap 58 and the front piece 48 adjacent the top of the adhesive strip 60 with at least one end thereof extending from between the flap 58 and the front piece 48 sufficiently for gripping. That will be recognized by those skilled in the art, cording, string, tape, or the like, as thus positioned can be used to fracture the flap 58 which in its originally secured position as just described acts as a tamperproof closing for the bag 44 prior to initial opening. As will also be recognized by those skilled in the art, other means for fracturing the flap 58 could be employed within the scope and spirit of the present invention such as providing a perforated tear strip within the flap 58 itself.

A pair of strips 66 and 68 of a hook and loop fastening system generally indicated as 70 are disposed between the flap 58 and the front piece 48 above and adjacent to the cording 64 with strip 66 adhesively attached to the flap 58 and strip 68 adhesively attached to the front piece 48. Again, for ease of manufacture, it is preferred that the strips 66,68 be adhesively attached to the flap 58 and front piece 48 by a hot melt adhesive (however, pressure sensitive adhesives, for example, could also be used). The hook and loop fastening system 70, comprising strips 66,68, is of a type generally well known to those skilled in the art and, in particular, sold by the assignee of this application under the trademark VELCRO. The preferred embodiment of the present invention as being described incorporates a new and novel embodiment of the hook and loop fastening system 70 which will be described in greater detail shortly.

Figure 8:
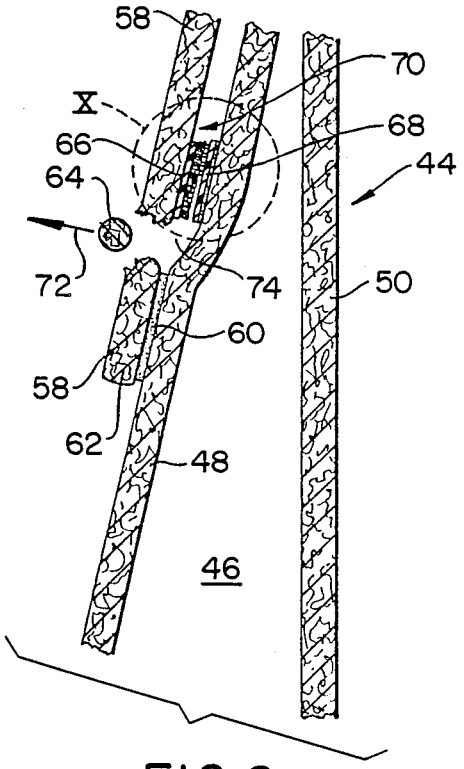
FIG. 8 shows the bag portion of FIG. 8 in the area of the resealable closing strips as the flap is being fractured by pulling of the cording.
Figure 9:
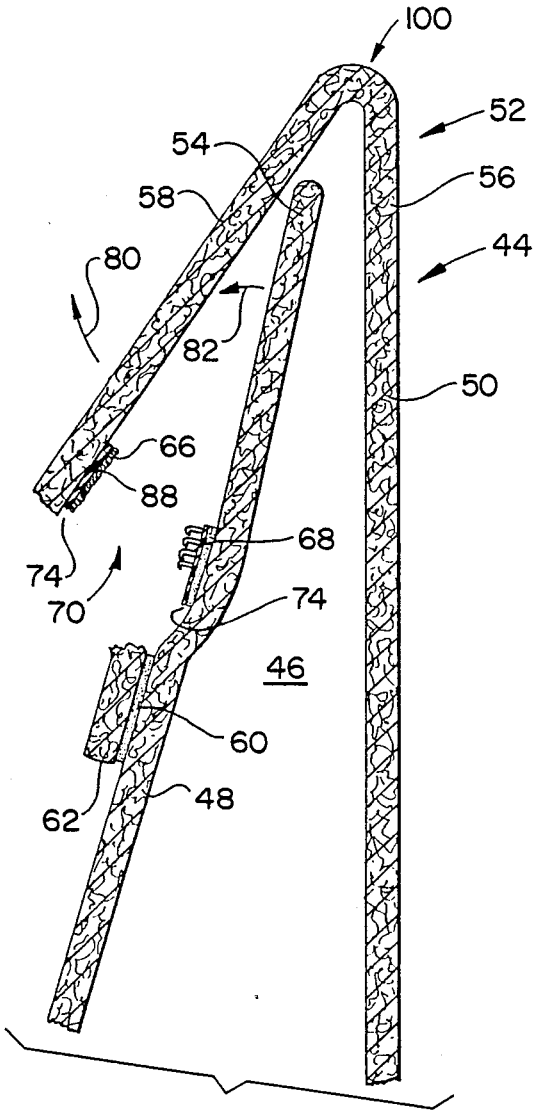
FIG. 9 shows the bag of FIG. 7 following the initial opening of FIG. 8 with the sealing strip released and the flap being raised for access to the bag.
Figure 11:
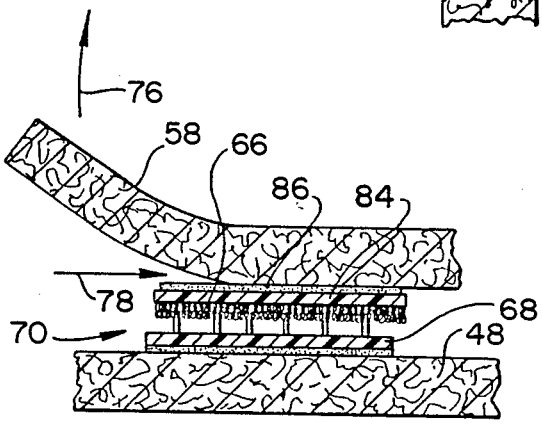
FIG. 11 PRIOR ART
FIG. 11 is a drawing showing the delamination problem solved by the strip fastening system of the present invention.

As shown in FIG. 8, as the cording 64 is pulled outwardly in the direction of arrow 72, the flap 58 is fractured and separated close adjacent the bottom edge 74 of the strips 66,68. By so doing, the strip 66 adhesively attached to the flap 58 can be gripped to pull it from its engagement from strip 68 without a delaminating problem depicted in FIG. 11 which would otherwise take place. As seen in FIG. 11, if the flap 58 were allowed to extend beyond the strip 66 and the peeling or separating force were applied in the direction of arrow 76, there is a good chance that, at least after several openings and closings, the flap 58 would delaminate at the adhesive 60 from the strip 66 at the point indicated by arrow 78. Shortly, flap 58 would then completely separate from strip 66 and the reclosability feature would be lost. By being able to grip strip 66 directly and apply the initial peeling force thereto, the delaminating problem of FIG. 11 is substantially avoided. Once the strips 66, 68 have been separated, the flap 58 can be lifted as indicated by the arrow 80 in FIG. 9 and front edge 54 pulled outward in the direction of arrow 82 to provide entrance to the bag 44. Closure and resealing is, of course, a reverse of the above-described procedure. The front and rear edges 54,56 are pressed together and the flap 58 pulled down over the front edge 54 until the strips 66,68 can be pressed together into releasable attachment with one another.

Figure 10:
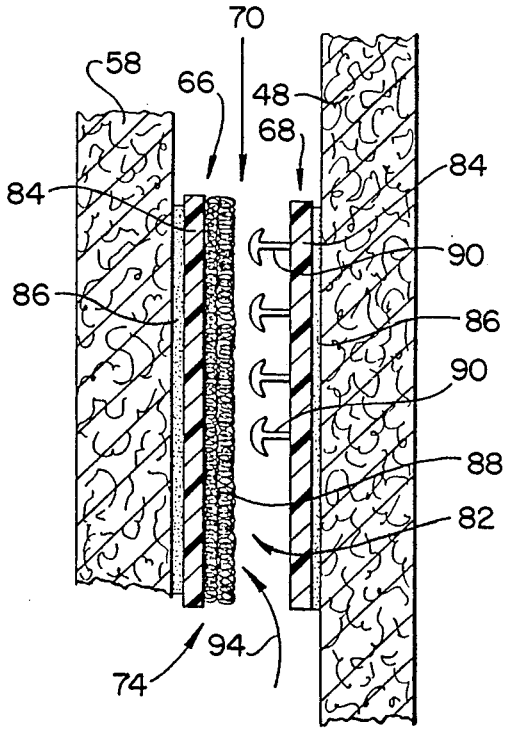
FIG. 10 is a detailed drawing in the area designated as X in FIG. 8 showing the details of the unique loop and hook fastening system of the present invention.

Turning now with particularlity to FIG. 10, the novel construction of the hook and loop fastening system 70 of the present invention will now be described in detail. As will be appreciated by those skilled in the art, the hook and loop fastening 70 provides benefits of delamination resistance for other uses besides bags as hereinbefore described when it is desired to apply the strip 66, 68 with an adhesive such as hot melt, or otherwise. In the usual manner, one loop strip (in this case strip 66) comprises a backing material 84 such as polypropylene adapted to adhere to the adhesive 86 and covered with a loop material 88. The other strip (in this case strip 68) also has a backing 84 to which adhesive 86 will adhere with resiliently flexible "J" or "T" hooks 90 extending therefrom. To accomplish the purposes desired, an area at 92 is provided where the strips 66,68 will not adhere to one another. This is most easily accomplished by eliminating the hooks 90 in that area. In the preferred embodiment, the hooks 90 are disposed in longitudinal rows and to provide the area 92 at least one row, and preferably two or three, is eliminated. As a consequence, if outward pressure is exerted within the area 92 as symbolized by the arrow 94, strip 66 (in combination with the bottom of flap 58) can be rolled back sufficiently to allow the bottom edge of the strip 66 to be grip securely such that the strips 66,68 can be pulled out of their entangled engagement with one another wherein the hooks 90 are entangled into the loop material 88. The fold point 100 affords placement of the strips of the hook and loop fastening system 70 in substantial alignment with one another along their longitudinal edges so that one strip overlies the other strip.

Figure 12:
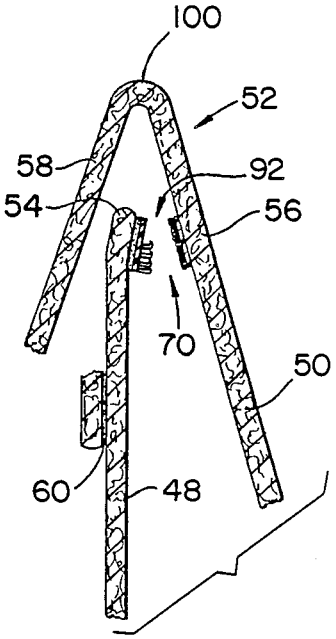
FIG. 12 is a drawing similar to that of FIG. 7 showing an alternate embodiment of the present invention.

The unique hook and loop fastening system 70 as thus described can also be incorporated into an alternate embodiment of the bag of the present invention as shown in FIG. 12. In this embodiment, the bag 96 is of substantially the same construction as bag 44 of the preferred embodiment. The hook and loop fastening system 70, however, is moved to a point wherein one strip is attached to the front edge 54 and the other to the rear edge 56 with the above described area 92 off the top 52. The flap 58 was attached with the adhesive 60 as previously described and with separation means such as the cording 64 adjacent thereto. Once opened, the flap is not resealable in this embodiment but the top 52 was resealable at the front and rear edges 54,56 by means of the fastening system 70 disposed therein. Because of the unique construction of the fastening system 70 as described above and the area 92 for gripping provided thereby, the strip 66 and front edge 54 can be securely gripped to pull them out of engagement with the strip 68 without causing the delamination problem of the adhesive previously described.

Wherefore, having thus described my invention, it can be seen that the present invention not only provides a reclosable bag with improved sealing means as desired. But, additionally, an improved hook and loop fastening system for use in adhesively applied applications where delamination of the glue adhesion is avoided despite repeated openings and closings.

Wherefore, having thus described my invention, I claim:

1. In a bag of flexible, frangible material including a bottom, opposed spaced sides, and opposed spaced front and rear pieces terminating at the top in front and rear edges respectively, the improvement to provide tamperproof resealability comprising:

(a) a flap of the flexible, frangible material extending from the rear edge and descending from a fold-point downward over the front edge and down along the front piece;

(b) a strip of adhesive disposed along the bottom edge of said flap to secure it to the front piece;

(c) first and second elongated strips of a hook and loop fastening system disposed between said flap and front piece above and adjacent to said strip of adhesive with said first strip adhesively attached across the full width thereof to said flap and said second strip adhesively attached across the full width thereof to the front piece, one of said first and second strips including an engaging area along its upper longitudinal edge portion which is sufficiently narrower than the width of the engaging area of the other of said first and second strips, the remaining area along the lower longitudinal edge of the one strip lacking the ability for that strip to form an attachment to the adjacent area of the other strip;

wherein said fold-point of said flap provides a means of placing said strips in substantial alignment with one another along their longitudinal edges so that one strip substantially overlies the other strip; and (d) fracturing means disposed for fracturing and splitting said flap adjacent the bottom edge of said first and second strips whereby upon initial opening of said fracturing means said flap is fractured and separated along a line closely adjacent said lower edge of said strips and thereafter when said first strip engages and substantially overlies said second strip with said longitudinal edges substantially aligned, said flap and a sufficient portion adjacent the lower longitudinal edge of said first strip can be laterally rolled back away from said second strip, to be directly gripped by human fingers to laterally pull said first strip out of attachment with said second strip whereby the initial lateral separation forces of both strips are intermediate the longitudinal edges of the strips substantially along the boundary of said engaging area and said remaining area so that peeling of said lower longitudinal edges of the strips from said flap and said front piece is prevented thereby avoiding delamination of either strip from the member of the bag to which it is adhesively attached.

2. The resealability improvement to a bag of claim 1 wherein said fracturing means comprises:

a piece of cording disposed between said flap and the front piece adjacent the top of said adhesive strip with at least one end extending from between said flap and the front piece sufficiently for gripping.

3. The improvement to a hook and loop fastening system of claim 1 wherein:

(a) said first strip is covered with loop material;

(b) said second strip is covered with longitudinal rows of resiliently flexible hooks for releasably intermeshing with said loop material;

(c) said remaining area comprises a sufficient portion adjacent said lower longitudinal edge of said second strip where said hooks are missing; and (d) the area of said first strip aligned with said remaining area is the portion of the strip laterally rolled back to be directly gripped by human fingers.

4. In a bag of flexible, frangible material including a bottom, opposed spaced sides, and opposed spaced front and rear pieces terminating at the top in front and rear edges respectively, the improvement to provide tamperproof resealability comprising:

(a) a flap of the flexible, frangible material extending from the rear edge and descending from a fold-point downward over the front edge and down along the front piece;

(b) a strip of adhesive disposed along the bottom of said flap to secure it to the front piece;

(c) first and second elongated strips of a hook and loop fastening system disposed between said flap and the front piece above and adjacent to said strip of adhesive with said first strip adhesively attached across the full width thereof to said front piece and said second strip adhesively attached across the full width thereof to said flap, one of said first and second elongated strips having an engaging area along an upper longitudinal edge portion which is sufficiently narrower than the width of the engaging area of the other of said first and second strips, the remaining area along the lower longitudinal edge of the one strip lacking the ability for that strip to form a releasable attachment to the adjacent area of said other strip;

wherein said fold-point of said flap provides a means of placing said strips in substantial alignment with one another along their longitudinal edges so that one strip substantially overlies the other strip; and (d) fracturing means disposed for fracturing and splitting said flap adjacent the bottom edge of said first and second strips whereby upon initial opening with said fracturing means said flap is fractured and separated along a line closely adjacent said lower longitudinal edge of said strips so that thereafter said flap and a sufficient portion along the lower longitudinal edge of said second strip can be laterally rolled back away from said first strip to be directly gripped sufficiently by human fingers to laterally pull said second strip out of attachment with said first strip wherein the initial lateral separation forces of both strips are intermediate the longitudinal edges of said strips substantially along the boundary of said engaging area and said remaining area so that peeling of said lower longitudinal edges of the strips from said flap and said front piece is prevented thereby avoiding delamination of either strip from the member of the bag to which it is adhesively attached.

5. The resealability improvement to a bag of claim 4 wherein:

one of said first and second strips is covered with a loop material;

the other of said first and second strips is covered with longitudinal rows of resiliently flexible hooks for releasably intermeshing with said loop material; and one complete said row of hooks adjacent said longitudinal lower edge is missing whereby said area for gripping extends along the entire length of said pair of strips.

6. The resealability improvement to a bag of claim 4 wherein said fracturing means comprises:

a piece of cording disposed between said flap and the front piece adjacent the top of said adhesive strip with at least one end extending from between said flap and the front piece sufficiently for gripping.

7. The improvement to a hook and loop fastening system of claim 4 wherein:

(a) said second strip is covered with loop material;

(b) said first strip is covered with resiliently flexible hooks for releasably intermeshing with said loop material;

(c) said remaining area comprises a sufficient portion adjacent said lower longitudinal edge of said first strip where said hooks are missing; and (d) the area of said second strip aligned with said remaining area is the portion of the strip laterally rolled back to be directly gripped by human fingers.

* * * * *